United States Patent [19]

Stendahl

[11] 4,371,033

[45] Feb. 1, 1983

[54] GAS-TO-GAS HEAT EXCHANGER

[75] Inventor: Gunnar Stendahl, Linköping, Sweden

[73] Assignee: STAL-LAVAL Apparat AB, Linköping, Sweden

[21] Appl. No.: 243,556

[22] Filed: Mar. 13, 1981

[51] Int. Cl.[3] ..... F28D 13/00; F28C 3/16

[52] U.S. Cl. ..... 165/104.16; 165/104.18; 165/104.34

[58] Field of Search ..... 165/104.16, 104.34, 165/104.18

[56] References Cited

U.S. PATENT DOCUMENTS 3,996,099 12/1976 Faugeras et al. ..... 165/104.16 X 4,249,594 2/1981 Elkins et al. ..... 165/104.16 X

FOREIGN PATENT DOCUMENTS 2546543 5/1976 Fed. Rep. of Germany ..... 165/104.16

*Primary Examiner*—Albert W. Davis, Jr.

*Attorney, Agent, or Firm*—Watson, Cole, Grindle & Watson

[57] ABSTRACT

A gas-to-gas heat exchanger comprises a chamber through which pass upwardly at least one first tube for the passage of a first hot gaseous medium and at least one second tube for the passage of a second cooler gaseous medium. The first and second tubes are disposed in spaced-apart relationship and a fluidized bed of particulate material, for example sand, is created in the chamber in the spaces around the tubes, the fluidized bed serving as a heat transfer medium from the first tube(s) to the second tube(s). The heat exchanger, which is particularly suitable for preheating air by heat exchange with a hot, dust-laden gas, may comprise a plurality of the chambers disposed one above the other.

5 Claims, 4 Drawing Figures

FIG. 1
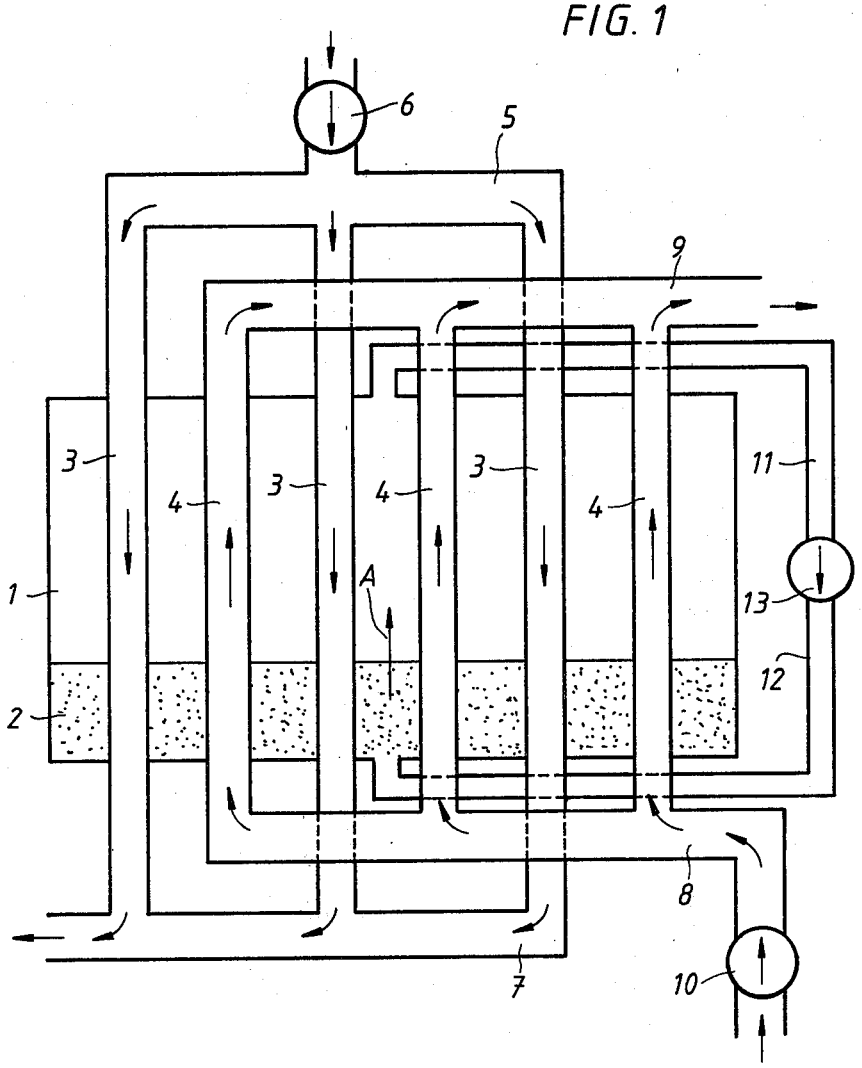
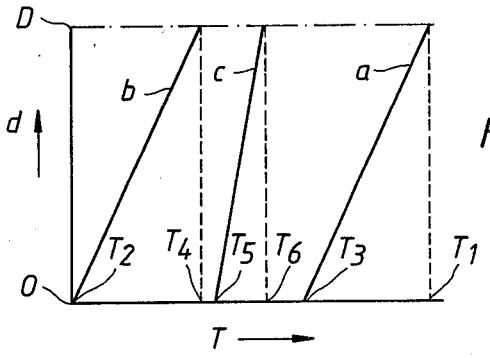
FIG. 2

GAS-TO-GAS HEAT EXCHANGER

TECHNICAL FIELD

This invention relates to a gas-to-gas heat exchanger. In particular, but not exclusively, the invention relates to an air preheater in which air is heated by heat exchange with a heated, dust-laden gaseous medium.

BACKGROUND ART

In certain processes where there is a need for heat recovery, it is sometimes required to effect a heat exchange between, on the one hand, air and, on the other hand, a heated gaseous medium, in particular a dust-laden gas which is rich in carbon monoxide, in order to effect a preheating of the air. Such an air preheating process is employed, for example, in the method of producing crude iron which is described in British Patent Specification No. 1,386,452. In such heat exchange processes, especially when the heated gaseous medium contains carbon monoxide, it is important that there should be no mixing of the heated gaseous medium and the air, so as to avoid contamination of the air and/or the creation of an explosive mixture. It has therefore been proposed to pass the air and the heated gaseous medium through separate tubes disposed in spaced-apart, horizontal relationship in a chamber, the chamber containing a particulate heat exchange medium, for example sand, surrounding the tubes. Such heat exchangers have various disadvantages, among which may be mentioned the risk of clogging of the tube(s) which conduct the heated gaseous medium, especially when the latter has a high dust content, and the poor heat transfer obtained via the particulate heat transfer medium.

The present invention aims to provide a gas-to-gas heat exchanger which does not have the aforementioned disadvantages.

DISCLOSURE OF INVENTION

According to the present invention, a gas-to-gas heat exchanger comprises a chamber enclosing a bed of fluidizable particulate material, at least one first tube portion and at least one second tube portion each passing upwardly through at least part of said chamber, said at least one first tube portion being disposed in spaced-apart relationship with respect to said at least one second tube portion, means for introducing a first gaseous medium at a first temperature into said at least one first tube portion for passage therethrough, means for introducing a second gaseous medium at a second temperature lower than said first temperature into said at least one second tube portion for passage therethrough, and means for passing a third gaseous medium through said chamber for creating a fluidized bed of said particulate material, whereby said fluidized bed serves as a heat transfer medium from said at least one first tube portion to said at least one second tube portion.

In use of a heat exchanger in accordance with the invention, it is preferred that the first and second gaseous media should flow in opposite directions in their respective tube portions. In this case it is preferred that the first gaseous medium (which is introduced into said at least one first tube portion at said first temperature) should flow downwardly in the chamber and that the second gaseous medium (which is introduced into said at least one second tube portion at a temperature which is lower than said first temperature) should flow upwardly in the chamber. This has the advantage that the first gaseous medium follows a natural gravitational path and this greatly reduces the risk of clogging of said at least one first tube portion compared with hitherto known heat exchangers in which the gas-conducting tubes were disposed horizontally. This is particularly important when the first gaseous medium has a high dust content.

Another advantage, when a heat exchanger in accordance with the invention is in use, is that the third gaseous medium carries away any of the first and second gaseous media which may accidentally leak from said at least one first and second tube portions. When, for example, the first gaseous medium is a gas rich in carbon monoxide and the second gaseous medium is air, the third gaseous medium passing through the chamber eliminates, or at least very considerably reduces, the risk of the air in said at least one second tube portion becoming contaminated with carbon monoxide. In such a case, it is preferred to use as the third gaseous medium a gas which, if it becomes mixed with carbon monoxide and air leaking from said tube portions, reduces the explosive character of the mixed carbon monoxide and air. Suitable gases for this purpose are nitrogen, carbon dioxide and helium.

Yet another advantage of a heat exchanger in accordance with the invention, when in use, is that the particulate material, fluidized by the third gaseous medium, provides an excellent heat transfer medium between said tube portions.

Preferably a heat exchanger in accordance with the invention comprises a plurality of said chambers arranged one above the other, said first and second tube portions having respective sections disposed in and passing upwardly through at least part of each chamber. In this way, a given heat exchange effect can be achieved in a plurality of stages instead of in a single stage when only a single chamber is used. This has the advantage that the temperature intervals between the three gaseous media in each stage are reduced, compared with employing a single chamber, which results in a reduced thermal stressing of the individual chambers.

When the heat exchanger comprises a plurality of chambers arranged one above the other, each chamber may be associated with a respective means for passing said third gaseous medium in a closed circuit through the chamber. Alternatively, the third gaseous medium may pass through all the chambers, one after the other.

BRIEF DESCRIPTION OF DRAWINGS

The invention will now be described, by way of example, with reference to the acccompanying drawings, in which FIG. 1 is a schematic, sectional side view of one embodiment of a single stage heat exchanger in accordance with the invention, FIG. 2 is a graph showing the temperature of the gaseous media passing through the heat exchanger of FIG. 1.

Figure 3:
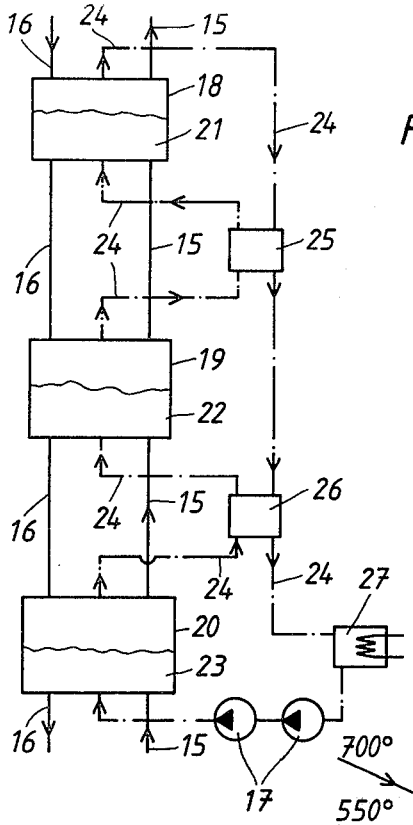
FIG. 3 is a schematic sectional side view of one embodiment of a three stage heat exchanger in accordance with the invention.

The gas-to-gas heat exchanger shown in FIG. 1 comprises a chamber 1 in which there is a layer 2 of particulate material, for example sand. Within the chamber 1 are vertically disposed, spaced-apart tube portions 3 and 4. The tube portions 3 are connected at their upper ends to a header pipe 5 serving as a means for introducing a first gaseous medium into the tube portions 3 through which the first gaseous medium flows downwardly. If necessary, a blower 6 may be associated with the header pipe 5 to establish the desired downward flow of the first gaseous medium in the tube portions 3. At their lower ends, the tube portions 3 are connected to a further header pipe 7 for conducting the first gaseous medium away from the chamber 1.

In like manner, the lower ends of the tube portions 4 are connected to a header pipe 8 for introducing a second gaseous medium into the tube portions 4 through which the second gaseous medium flows upwardly and is collected in a header pipe 9 to which the upper ends of the tube portions 4 are connected. If necessary, a blower 10 may be associated with the header pipe 8 to establish the desired upward flow of the second gaseous medium in the tube portions 4.

The upper and lower ends of the chamber 1 are connected to pipes 11 and 12, respectively, which are connected to the inlet and outlet sides, respectively, of a blower 13 for circulating a third gaseous medium in a closed cycle through the chamber 1 in the direction indicated by the arrow A.

In use of the heat exchanger shown in FIG. 1, the blower 13 is set in operation to circulate the third gaseous medium through the chamber 1 and to create a fluidized bed of the layer 2 of particulate material. The first gaseous medium is introduced into the upper ends of the tube portions 3 at a temperature $T_1$, and the second gaseous medium is introduced into the lower ends of the tube portions 4 at a temperature $T_2$, lower than $T_1$. As a result of the heat exchange effect of the fluidized particulate material in the chamber 1, the first gaseous medium passes to the header pipe 7 at a temperature $T_3$, lower than $T_1$, and the second gaseous medium passes to the header pipe 9 at a temperature $T_4$, higher than $T_2$. It is important that the lowest temperature $T_3$ of the first gaseous medium should be higher than the highest temperature $T_4$ of the second gaseous medium. The third gaseous medium enters the lower end of the chamber 1 at a temperature $T_5$ and leaves the upper end of the chamber at a higher temperature $T_6$. FIG. 2 shows the relationship between the temperatures $T_1$–$T_6$.

In FIG. 2 the lines a, b and c are curves of the temperature T of the first, second and third gaseous media, respectively, plotted against distance d measured from the bottom of the chamber 1, the point O representing the bottom of the chamber and the point D the top of the chamber.

In one embodiment of the heat exchanger of FIG. 1, which used a dust-laden gas rich in carbon monoxide (the first gaseous medium) for pre-heating air (the second gaseous medium), the particulate material in the layer 2 was sand having a particle size of about 0.2 mm and this was fluidized with carbon dioxide gas (the third gaseous medium). The temperature $T_1$ of the gas entering the tube portions 3 was 800° C. and the temperature $T_3$ of the gas leaving the tube portions 3 was 700° C. In passing through the tube portions 4, the air was heated from an entry temperature $T_2$ of 550° C. to an exit temperature $T_4$ of 650° C. The temperatures $T_5$ and $T_6$ of the carbon dioxide entering and leaving the chamber 1 were a few degrees below and a few degrees above 675° C., respectively.

FIG. 3 shows very schematically a three-stage air preheater with three chambers 18, 19 and 20 arranged one above the other and containing layers 21, 22 and 23, respectively, of fluidizable particulate material for example sand. Hot, dust-laden gas and air are led in separate, vertically disposed tube systems through all the chambers, the gas flow being indicated by the line 16 and the air flow being indicated by the line 15. The tube systems within the chambers may be arranged in the same way as in the embodiment of FIG. 1. The layers 21, 22 and 23 are fluidized with carbon dioxide or nitrogen gas which is led through the three chambers as indicated by the line 24. The hot fluidizing gas leaving the uppermost chamber 18 (for example at a temperature of about 675° C.) passes through a heat exchanger 25 in counterflow relationship with the fluidizing gas passing from the chamber 19 to the chamber 18 and through a heat exchanger 26 in counterflow relationship with the fluidizing gas passing from the chamber 20 to the chamber 19. After passing through the heat exchanger 25 the fluidizing gas has a temperature of about 600° C. and after passing through the heat exchanger 26 it has a temperature of about 525° C. After leaving the heat exchanger 26 the fluidizing gas passes through a water heater 27 in which water is heated and the fluidizing gas is cooled to about 300° C. At this temperature the fluidizing gas is re-introduced to the bottom of the chamber 20 by fans 17.

The hot, dust-laden gas enters the chamber 18 at a temperature of about 800° C. and leaves this chamber at a temperature of about 700° C. Corresponding temperature intervals for the chambers 19 and 20 are about 700°–600° C. and about 600°–500° C., respectively.

Figure 4:
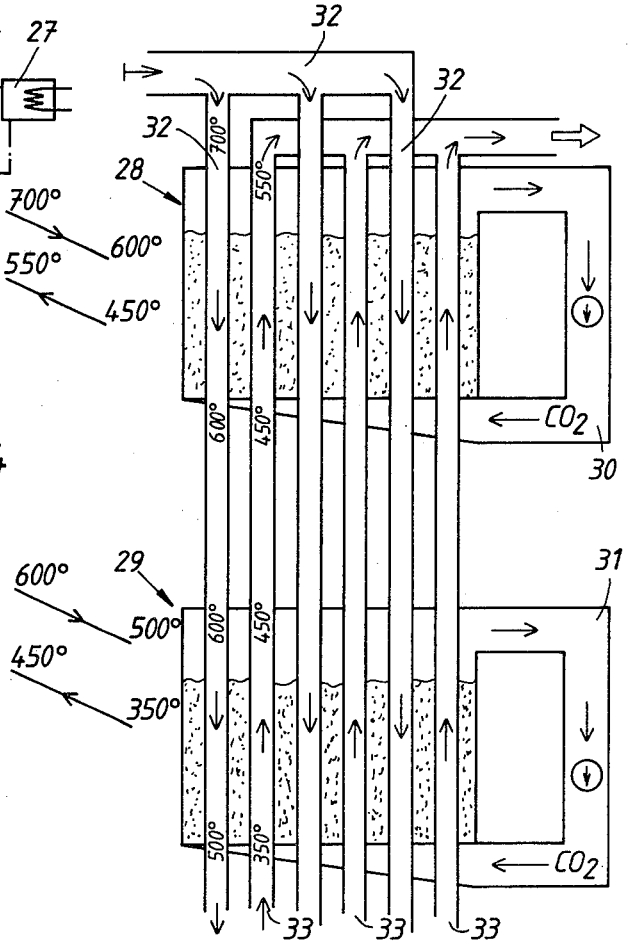
FIG. 4 is a schematic, sectional side view of one embodiment of a two stage heat exchanger in accordance with the invention.

FIG. 4 shows a two-stage air preheater comprising a chamber 28 arranged above a chamber 29, each chamber, as in the previous embodiments, containing a layer of fluidizable particulate material, for example sand. The fluidizing gas for the particulate material, which in this case is carbon dioxide gas, is circulated through the chamber 28 by a closed system 30 and through the chamber 29 in a closed system 31. Vertical tubes 32 for hot, dust-laden gas and vertical tubes 33 for the air to be preheated pass through both chambers, and are positioned alternately adjacent each other, which provides for a good heat transfer.

The invention is not, of course, limited to the embodiments described in detail above. In particular, other arrangements of the tube portions for conveying the first and second gaseous media through the chamber(s) may be used.

What is claimed is:

1. A gas-to-gas heat exchanger, comprising at least two chambers each enclosing a bed of fluidizable particulate material, a first set of tubes and a second set of tubes passing substantially vertically through at least part of each of said chambers; said first and second sets of tubes being mutually disposed in spaced-apart relationship; means for introducing a first gaseous medium at a first temperature into said first set of tubes for downward passage therethrough, means for introducing a second gaseous medium at a second temperature, lower than said first temperature, into said second set of tubes for upward passage therethrough, and means for passing a third gaseous medium through said chambers for creating fluidized beds of said particulate material, whereby said fluidized beds serve as heat transfer media from said first tube sets to said second tube sets, thus obtaining heat transfer in a plurality of temperature stages, one for each of said chambers.

2. A heat exchanger according to claim 1, wherein said chambers are arranged one above the other, said first and second tube sets having respective sections disposed in and passing downwardly and upwardly, respectively, through at least part of each of said chambers.

3. A heat exchanger according to claim 2, wherein the uppermost one of said chambers is arranged to operate at a higher temperature for the first gaseous medium than the temperature of the underlying one of said chambers, the second gaseous medium thus assuming a higher outlet temperature in said uppermost chamber than in said underlying chamber.

4. A heat exchanger according to claim 1, wherein there comprises a plurality of each of said first and second tube sets, said first tube sets being arranged alternately with said second tube sets.

5. An air preheater comprising, a plurality of chambers disposed one above the other, each of said chambers enclosing a respective bed of fluidizable particulate material, at least one first tube and at least one second tube having a respective portion disposed substantially vertically in each of said chambers, means for introducing a hot gaseous medium at a first temperature into said at least one first tube for downward passage therethrough, means for introducing air to be preheated, at a second temperature lower than said first temperature, into said at least one second tube for upward passage therethrough, and means for passing a third gaseous medium through said chambers for creating a fluidized bed of said particulate material in each of said chambers, whereby in each of said chambers said fluidized bed serves as a heat transfer medium from the portion of said at least one first tube in the chamber to the portion of said at least one second tube in the chamber.

* * * * *